United States Patent [19]

Hauser

[11] 3,951,058

[45] Apr. 20, 1976

[54] DRAINAGE SYSTEM FOR PRESSES FOR OBTAINING JUICE FROM FRUIT, GRAPES AND SIMILAR PRESSED MATERIAL

[75] Inventor: Hans Ulrich Hauser, Niederweningen, Switzerland

[73] Assignee: Bucher-Guyer, AG, Maschinenfabrik, Niederweningen, Switzerland

[22] Filed: Apr. 16, 1975

[21] Appl. No.: 568,576

[30] Foreign Application Priority Data

Apr. 16, 1974 Germany ..... 2418341

[52] U.S. Cl. ..... 100/107; 100/125

[51] Int. Cl.[2] ..... B30B 9/02; B30B 9/06

[58] Field of Search ..... 100/104, 107, 108, 109, 100/110–116, 125, 126

[56] References Cited

UNITED STATES PATENTS

| | | | |
|---|---|---|---|
| 3,103,164 | 9/1963 | Willmes | 100/107 |
| 3,207,064 | 9/1965 | Hauser-Bucher | 100/107 |
| 3,513,769 | 5/1970 | Sutter-Christ | 100/107 |

FOREIGN PATENTS OR APPLICATIONS

| | | | |
|---|---|---|---|
| 413,599 | 12/1966 | Switzerland | 100/107 |

*Primary Examiner*—Peter Feldman

[57] ABSTRACT

A drainage system for fruit presses including a pressing cylinder and a pressure plate and back pressure plate assembly moveable toward each other. A flexible traction means including an elongate flexible core and a flexible perforated casing for allowing juice to pass therethrough while filtering same. The core having a substantially larger cross-sectional area at its central portion than at its ends. The core defining longitudinally extending channels throughout its length.

5 Claims, 3 Drawing Figures

DRAINAGE SYSTEM FOR PRESSES FOR OBTAINING JUICE FROM FRUIT, GRAPES AND SIMILAR PRESSED MATERIAL

The invention relates to a drainage system for presses for obtaining juice from fruit, grapes and similar pressed material, with a horizontal rotatable pressing cylinder, a pressure plate and a back pressure plate and flexible tension or traction means clamped between the plates and consisting of a flexible core provided with longitudinal channels and a casing or cover allowing the juice to pass through and filtering the pressed juice.

In a drainage system according to prior art of this type, such as is shown in German Publication DOS 1,502,181, the disclosure of which is here incorporated by reference, the flexible core of the traction means has a uniform cross-section over its entire length. Because the space conditions for the anchorage of the multiplicity of traction means at the pressure and back pressure plate are limited, according to prior art the cross-section of the core of the traction means had to be maintained relatively small. Another reason for limiting the cross-section of the core also resides in assuring the flexibility of the ends of the core at both clamping points on the pressure and back pressure plates.

This is contrary to the need for as large a traction means filtering surface as possible thereby to accomplish an increase in the efficiency, that is an increase in the juice yield and a reduction of the pressing times.

Consequently, the invention is based on the problem of increasing the filtration surface of the traction means against the known drainage systems without substantial reduction of their flexibility.

Accordng to the invention this problem is solved in a drainage system of the kind initially mentioned in that the core, over a major portion of its length has a larger cross-section surface than does its two ends to be anchored at clamping points, whereby the longitudinal channels extending over the major part of the core length have a conductive connection with longitudinal channels which are provided at the ends, thereby to form a duct.

According to a preferred embodiment, the traction means furthermore are characterized by the fact that the core, viewed in cross-section, has at least two branches formed by recesses and which originate from one base part. Thereby, although the cross-section area is maintained small, a large filtering surface is provided, whereas the core also has the desired flexibility over its entire longitudinal length. When the core is star-shaped in cross-section, this is preferred.

Below the invention is explained more in detail by means of an embodiment represented in the drawings, of which:

Figures 1, 2, 3:
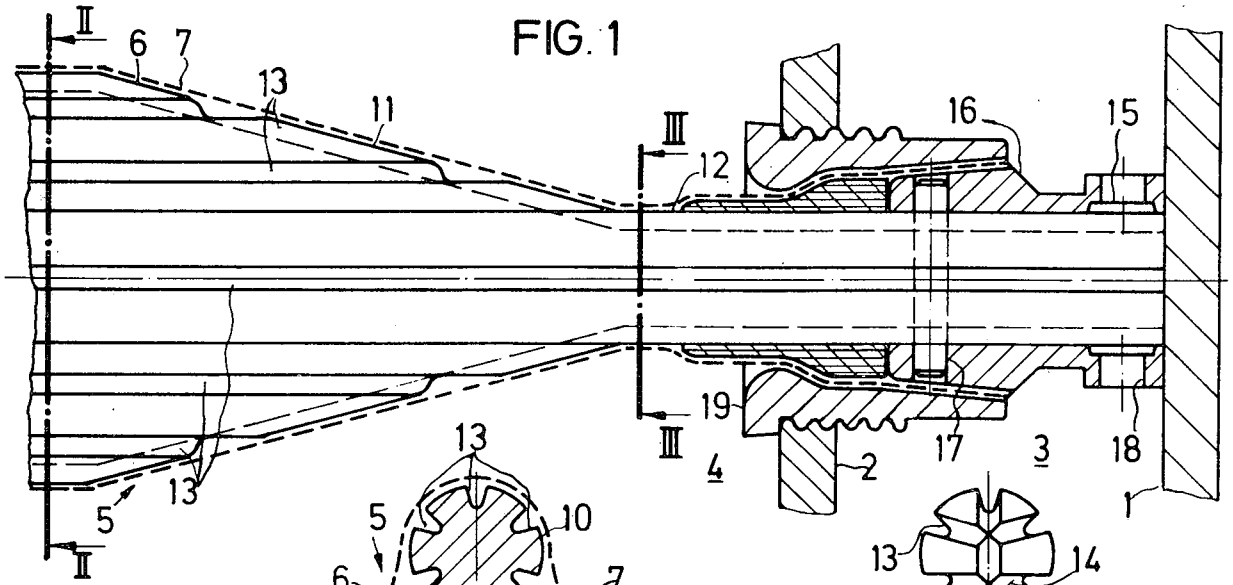
FIG. 1 shows in lateral view one end of the traction means and one clamping point at the pressure plate drawn in cross-section.
FIG. 2 shows a cross-section through the traction means according to line II—II of FIG. 1.
FIG. 3 shows a cross-section through one end of the core, according to line III—III of FIG. 1.

Only the partial portion of one pressure plate 1 and one fastening plate 2 are shown of a press. For more detail of an overall typical assembly and its mode of operation, German DOS 1,502,181 may be referred to, from which it will be understood that the fastening plates will be the same at each end of the traction means. Between these plates 1 and 2 a frontal juice collection area 3 is delimited. A plurality of elongate traction means extending from a back pressure plate (not shown, but see DOS 1,502,181) and of which traction means only one end portion is illustrated in the drawing, extend through a pressing area 4 abutting the juice collection area 3.

Each traction means 5 comprises a flexible core 6 and a perforated casing 7 through which juice may pass surrounding the core. As FIG. 2 shows, the main body of the flexible core 6 has a star-shaped cross-section, having three branchings 10 extending from one base part 9, with concave regions or recesses 8 between the branchings and the base part. The flexible core 6 tapers from its central region towards each end 12. The tapering region is a generally conical part 11. The circular cross-sections of ends 12 are approximately of the same size as the base part 9.

At its base part 9, and at the branchings 10, the core 6 is provided with longitudinal channels 13. The longitudinal channels 13 defined by the base part 9 continue in straight alignment as far as the front side of the ends 12 which also define longitudinal channels. The longitudinal channels 13 located outermost at the branches 10 extend via the conical part 11 toward the ends 12. As shown in FIG. 3, the longitudinal channels 13 arranged laterally at the branchings 10 are conductively connected via transverse channels 14 to the longitudinal channel portions 13 in the conical part 11. As a result, all longitudinal channels 13 eventually terminate in an annular area 15 of a conical part 16 which is removably connected by means of a transverse bolt 17 to the end of the flexible core 6.

The anchoring of the traction means 5 is accomplished in such a manner that by tightening of a screw casing 19 in the fastening plate 2 the conical part 16 is clamped between the fastening plate 2 and the pressure plate 1, with the casing 7 being clamped in simultaneously between the conical part 16 and the screw casing 19. The same anchorage also exists at the other end of the traction means 5 at the opposite side on the back pressure plate of the press.

As the pressed material filled into the pressing area 4 is pressed, the juice is forced to pass, under filtration effect, through the perforated casing 7 and flows along the longitudinal channels 13 and the transverse channels 14 into the annular area 15, from which the juice can flow via openings 18 into the juice collection area 3.

With increasing pressing, that is with reduction of the distance between the pressure and back pressure plate by moving one toward the other (see DOS 1,502,181) the traction means 5 is bent and moved more and more into the transverse plane of the pressing area 4, and each such traction means channels the juice from the interior, pressing area of the cylinder to the juice collection areas 3. After the pressing is accomplished, in order to loosen the pressed cake, the pressure plate is retracted and returned to its starting position. With this return movement, the traction means 5 again extend into their approximately horizontal longitudinal disposition. This alternate pressing and loosening is repeated several times until a sufficient degree of squeezing has been reached.

With the movement of the traction means, the core 6 must be able to bend. The smallest bending radii is located at the clamping points at the fastening plates 2. One advantage of the invention resides in the fact that the ends 12 of the core have a very small cross-section, and thus they are very flexible and more than if the entire length of the core was, for example, of the cross-sectional area of the main body portion of the core.

The progress attainable with the new cross-sectional form of the core 6 of the traction means is of essential significance. On the one hand, thanks to its relatively small cross-sectional surface, the core 6 is very flexible over its entire length and, on the other hand, despite their small cross-section surface, the cores have a large filter surface which provides for an optimal juice yield and for a reduction of the pressing time.

Instead of the cross-sectional form shown in the drawing, quite different variants of embodiments are possible in the core of the traction means. However, according to the invention it is essential that, when viewed in cross-section, the core has at least two branchings originating from a base part and that there be concave regions or recesses between the base part and the branchings which extend therefrom.

I claim:

1. In a drainage system for presses for obtaining juice from fruit, grapes and similar pressed material, comprising a pressing cylinder and a pressure plate and a back pressure plate movable relative towards each other, flexible traction means clamped between said plates and comprising an elongate flexible core and a flexible perforated casing for allowing juice to pass therethrough surrounding said core for filtering the pressed juice, said core having ends, one of which ends is clamped adjacent each of said plates, said core having a substantially larger cross-sectional area along a major central part of its length than it has at its said ends, and longitudinal channels defined by said core and extending along the major part of the core length, and longitudinal channels defined by said ends, and connective channels interconnecting said major part channels and said end channels.

2. In a drainage system for presses in accordance with claim 1, in which the major part of said core comprises a base part and at least two branchings extending from said base part, the branchings and said base part defining concave recesses when viewed in transverse cross-section.

3. In a drainage system for presses in accordance with claim 2, in which the major part of said core is star-shaped in transverse cross-section.

4. In a drainage system for presses in accordance with claim 2, in which said major part terminates outwardly in tapering regions which merge with the ends, and in which said ends are generally circular in transverse cross-section.

5. In a drainage system for presses in accordance with claim 2, in which said tapering portion defines transverse channels for establishing communication between said core longitudinal channels and said end longitudinal channels.

* * * * *